US005277600A

United States Patent [19]

Meixler

[11] Patent Number: 5,277,600

[45] Date of Patent: Jan. 11, 1994

[54] ELECTRICAL PLUG SAFETY LOCK

[76] Inventor: Lewis D. Meixler, 11 Cherry Brook La., E. Windsor, N.J. 08520

[21] Appl. No.: 876,027

[22] Filed: Apr. 30, 1992

[51] Int. Cl.[5] ..... H01R 13/44

[52] U.S. Cl. ..... 439/134; 439/304; 439/367

[58] Field of Search ..... 439/133, 134, 304, 367

[56] References Cited

U.S. PATENT DOCUMENTS

| | | | |
|---|---|---|---|
| 3,416,123 | 12/1968 | Husebo | 439/134 |
| 3,422,389 | 1/1969 | Husebo | 439/134 |
| 4,025,140 | 5/1977 | Matys | 439/134 |
| 4,957,446 | 9/1990 | Belsky | 439/134 |
| 5,055,057 | 10/1991 | Bayer | 439/304 |
| 5,176,527 | 1/1993 | Herbert | 439/134 |

*Primary Examiner*—Paula A. Bradley

[57] ABSTRACT

An apparatus for securing the prongs of an electrical appliance plug into a block of strong, flexible plastic. The block has a pair of grooves spaced at the appropriate distances to accommodate the parallel prongs of a standard electrical plug. Additionally, the block has an aperture to receive the third, or grounding prong of the electrical plug. A hole, receptive of a bolt, exists at right angles to the direction of insertion of the plug. The hole has a clearance region through the middle and the section of the block adjacent to the bolt head, but is threaded at the section which is opposite the bolt head. The bolt is of the appropriate length to traverse the width of the block when fully tightened into the block. Additionally, the hole may be recessed to form a depression around the bolt head to discourage tampering or probing. Similarly, a recessed region may be formed on the face of the block into which the plug is inserted to likewise discourage tampering or probing. In operation, once the plug prongs are inserted into the block, the bolt is tightened, and retentive force is applied to the prongs of the plug to prevent removal. Optionally, a groove may be positioned on the side of the block, and a hole may be located in the end of the bolt. This combination allows the shackle of a padlock to be inserted into the shank of the bolt, to retain the bolt in the block. Once the bolt is tightened into the appropriate position, the padlock shackle is inserted into hole in the shank. The groove cooperates with the shackle and prevents the loosening of the bolt thereby preventing the release of the plug until the padlock shackle is removed.

6 Claims, 1 Drawing Sheet

ELECTRICAL PLUG SAFETY LOCK

BACKGROUND—FIELD OF THE INVENTION

This invention relates generally to the field of devices designed to prevent the use of electrical equipment or appliances by securing the electrical plug, and more specifically to a device which will captively surround the prongs of the electrical plug in such a manner that young children, elderly persons, or mentally retarded persons cannot gain access to their use. Optionally, the operation of the Electrical Plug Safety Lock can be secured with a padlock to discourage a wider selection persons unauthorized access to secured electrical equipment.

DOCUMENT DISCLOSURE

Attention is drawn to Document Disclosure number 266225, dated Oct. 23, 1990 entitled Safety Plug Lock.

BACKGROUND—DESCRIPTION OF THE PRIOR ART

It is desirable to prevent small children, elderly persons, or mentally retarded persons from being able to gain access to various household electrical appliances. The potential for injury to themselves or others from electrical saws, electric drills, soldering irons, etc. is a serious concern. The fire hazard potential from appliances such as clothes irons, toasters, soldering irons is also a concern in addition to the injury that these appliances may cause. Also, there are household appliances, which although not necessarily dangerous, parents may wish to restrict use by their young children. Such appliances may be televisions, radios, or various electrical games. Additionally, there are situations in business and industry where limited access to certain equipment is desirable from a safety, security or liability consideration. Examples of typical equipment might be computers, dangerous electrical machinery, or office equipment.

The prior art is rich with proposed devices whose purpose it is to render the use of electrical plugs inaccessible. U.S. Pat. Nos. 2,955,272; 2,844,805, 4,488,764, 4,666,224, and 4,673,230 all attempt to render the entire plug inaccessible by placing the plug within a locked enclosure. U.S. Pat. Nos. 4,640,107, 4,679,873 and 4,812,131 operate by securing the plug into a housing by using a mechanism for capturing the body of the electrical plug thereby attempting to prevent the withdrawal of the plug from the housing. U.S. Pat. Nos. 2,733,416, 3,662,320 and 3,543,544 all operate by securing or clamping the lock to the prongs of the plug using various locking mechanism. Furthermore, U.S. Pat. Nos. 2.654,073, 3,345,600, 3,539,968, 3,781,913, 4,413,490, 4,563,048 and 4,566,297 utilize the holes in the prongs of the plug, to secure a locking mechanism.

Many of the devices described have one or more objectionable features. The devices utilizing enclosures are unsightly and are necessarily large and unwieldy as a household or office item if they are to accommodate all sizes of plugs.

Locking devices which capture the plug into a housing by securing the plug body are equally awkward, will not work uniformly well on all sizes of plug bodies, or are unduly complicated, and expensive to manufacture. They may invite attempts to defeat them by being obvious in their operation.

The locking devices which have relied for their operation on the insertion of pins, or the shackle of a padlock through the holes in the prongs of the plug have several disadvantages. Any distortion of the alignment of the prongs of the plug, which many times occurs with use over an extended period of time, makes the insertion of the pins or shackle very difficult and therefore the locking device difficult to use. Additionally, the holes are the result of a manufacturing process, and are not of uniform diameter, or at a standard distance from the base. Also, some plug manufacturers do not provide plugs with holes.

Furthermore, many of the above devices will not work at all on the three prong type of plugs, because the center or grounding prong will interfere with the operation of the device.

OBJECTS AND ADVANTAGES

Accordingly, it is an object of this invention to provide a device to secure equally well an electrical plug of either the two prong or three prong type.

It is a further object of this invention to provide a safety device which can be used to prevent young children from gaining unauthorized access to electrical appliances which is very inexpensive, and easy to manufacture, thereby making it feasible for a family, household, or school etc., to afford as many devices as necessary to provide adequate protection. Similarly, the same safety device may be used in nursing homes, or institutions where it is desired to protect senile, or mentally retarded persons from gaining access to certain appliances.

A further object of this invention is provide a device which is simple to use, and which will not be objectionable in appearance.

Another object of this invention is the implementation of a device which will be simple enough in operation to enable virtually all adults to operate it, but not so simple that children or adults of limited physical or ability can defeat it.

Still another objective is to provide a device which may or may not be locked using a locking device at the option of the user.

DESCRIPTION OF THE DRAWINGS

These and other advantages of the invention will become apparent from the following detailed description, and the accompanying drawings in which.

SUMMARY OF THE INVENTION

Figure 1:
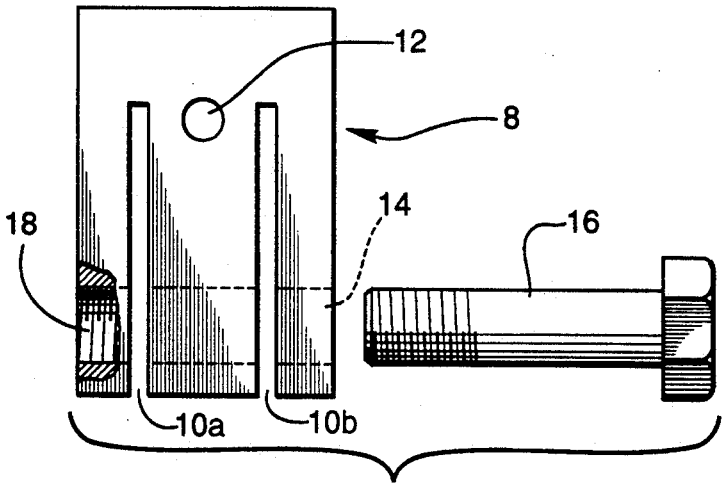
FIG. 1 is a view of the Electrical Plug Safety Lock showing the surface into which the electrical plug is inserted to be retained in its captive position.

The preferred embodiment of the Electrical Plug Safety Lock is illustrated in FIG. 1. The preferred embodiment is a block 8 which can be molded extruded or machined from a strong, flexible plastic such as a nylon, polyhexamethylene-adipamide, available from E. I du-Pont Nemours, Inc. and sold under the trademark (DELRIN). The block has a pair of grooves 10*a* and 10*b* typically 1/16 inch wide spaced at the appropriate distances to accommodate the parallel prongs of a standard electrical plug. Grooves 10*a* and 10*b* form a trifurcated region in block 8. Grooves 10*a* and 10*b* may be fabricated by machining, molding, or as part of the extrusion process. Furthermore, grooves 10*a* and 10*b* may have their edges chamfered to aid in the insertion of the plug prongs into the block. Additionally, block 8 has a hole 12, typically ¼ inch in diameter spaced at the proper location above and between grooves 10*a* and 10*b* to receive the third, or grounding prong of the electrical plug. Hole 12 may be formed by molding or drilling, or extrusion. An additional hole 14 exists at right angles to the direction of insertion of the plug. Hole 14 is receptive of a bolt 16. Hole 14 has a clearance region hole through the middle trifurcated section, and also the trifurcated section adjacent to the bolt head, but is threaded at the trifurcated section which is opposite the bolt head. The threaded section is identified as surface 18. Bolt 16 is of the appropriate length to traverse the width of the block when fully tightened into the block after engaging threaded surface 18. In the preferred embodiment, bolt 16 is typically has a Torx or Allen head, requiring a Torx or Allen wrench to tighten, although any standard bolt of the appropriate thread and length will suffice. Additionally hole 14 may be recessed to form a depression around the bolt head to discourage tampering or probing. Similarly, a recessed region can be formed on the face of block 8 into which the plug is inserted to likewise discourage tampering or probing.

Figure 2:
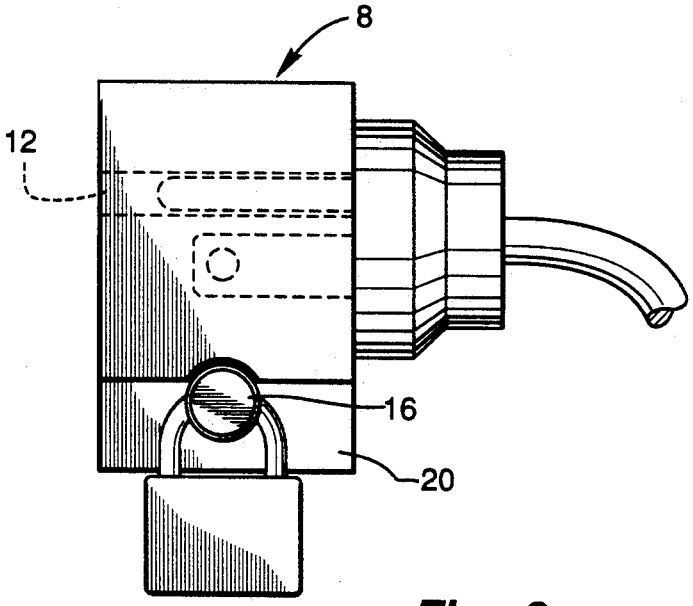
FIG. 2 is a side view of the Electrical Plug Safety Lock in which a padlock is used to secure the mechanism from allowing the captive bolt to be removed.
Figure 3:
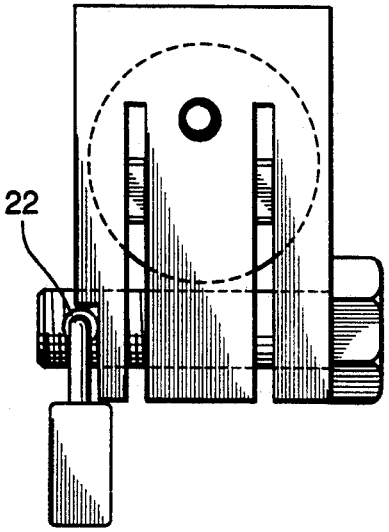
FIG. 3 is an end view of the Electrical Plug Safety Lock and an electrical plug in the locking configuration shown in FIG. 2.

FIG. 2 shows an alternate embodiment of FIG. 1, in which a groove 20, is molded, machined or extruded into block 8. Hole 22 is positioned into the end of bolt 16, which allows the shackle of a padlock to be inserted into the shank of bolt 16. In operation, once bolt 16 is tightened into the appropriate position, the padlock shackle is inserted into hole 22 in the bolt shank. Hole 22 is located along the bolt shank such that in the tightened position, hole 22 is below the surface of the block. Groove 20 cooperates with the shackle to prevent rotation of bolt 16, thereby preventing the retraction of the bolt, and the release of the electrical plug prongs until the padlock shackle is removed. It is envisioned that alternative locking means can be used to prevent the rotation, and thereby loosening of the bolt once the plug prongs are secured. Such means may be incorporated with the body of the locking mechanism itself, thereby resulting in a self-contained locking unit.

OPERATION

FIG. 1 shows the best mode for using the Electrical Plug Safety Lock. The electrical plug which is to be captive is inserted into block 8, with the parallel prongs inserted into the parallel grooves, and the optional grounding prong inserted into the round hole. Once the plug is firmly seated into block 8, as far as it will go, bolt 16 is tightened thereby firmly clamping the prongs of the plug between the trifurcated sections of block 8, preventing release of the plug. Optionally, at this point, the shackles of a padlock can then be inserted through hole 22 of bolt 16, thereby securing bolt 16 in the tightened position by the blocking function of aperture 20. The plug is released by reversing the above procedure.

Having described the Electrical Plug Safety Lock invention, it should be apparent that many substitutions, modifications, and variations of the invention are possible in view of the above teachings. It is therefore to be understood that the invention as taught and described herein is only to be limited to the extent of the breadth and scope of the appended claims:

What is claimed is an Electrical Plug Safety Lock which is used in cooperation with an electrical plug which comprises:

1. (a) A generally cubic solid resilient plug prong receiving unit, having a front plug prong receiving surface, a base surface, a rear surface, a first side surface, and a second side surface; said receiving unit having two parallel slots receptive of a plug's parallel electrical prongs, extending perpendicularly inward from said base surface and traversing from said front surface to said rear surface; forming a first branched region adjacent to said first side, a second branched region adjacent to said second surface, and a third branched region centered between said first and second branched regions, the three branched regions forming a trifurcated region; a first aperture centered between and above said perpendicular slots extending perpendicularly into said front plug prong receiving surface receptive of a plug grounding prong; a second aperture parallel to said front surface extending through said receiving plug unit from said first side surface to said second side surface within said trifurcated region and closer to said base than region occupied by said plug electrical prongs, said second aperture having a non-threaded interior surface in said first branched region, and in said third branched region and a threaded interior surface in said second branched region; and, (b) said second aperture receptive of a threaded bolt, said threaded bolt having a bolt head and a threaded shank, said threaded bolt capable of exerting retentive force on a pair of said plug prongs when said bolt is tightened after said plug prongs are inserted into said two parallel slots, and thus said electrical plug is retained within said receiving unit by a clamping force preventing use of said electrical plug until said threaded bolt is loosened.

2. A generally cubic solid resilient plug prong receiving unit as in claim 1 in which said second side surface has a groove intersecting said second aperture; and in which said threaded shank has a hole perpendicular to the axis of said threaded shank, said hole located at the end of said threaded section opposite said bolt head, said hole receptive of a padlock shackle; said groove cooperating with said padlock shackle preventing removal or loosening of said bolt, thereby retaining retentive force on said plug prongs within said resilient plug prong receiving unit.

3. A generally cubic solid resilient plug prong receiving unit as in claim 1, or 2 in which the region on the first side surface surrounding the head of said bolt is recessed.

4. A generally cubic solid resilient plug prong receiving unit as in claim 1 or 2 in which the region surrounding the plug insertion area on said front surface is recessed.

5. A generally cubic solid plug prong receiving unit as in claims 1 or 2 in which the resilient material is polyhexamethylene—adipamide.

6. A solid resilient plug prong receiving unit as in claim 1 in which a locking means is incorporated to prevent the rotation of the said bolt shank once the bolt is in the tightened position.

* * * * *